US005232324A

United States Patent [19]

Graushar

[11] Patent Number: 5,232,324

[45] Date of Patent: Aug. 3, 1993

[54] APPARATUS AND METHOD FOR APPLYING COVERS TO SIGNATURES

[75] Inventor: William T. Graushar, Wauwatosa, Wis.

[73] Assignee: Quad/Tech, Inc., Sussex, Wis.

[21] Appl. No.: 773,025

[22] Filed: Oct. 7, 1991

[51] Int. Cl.[5] ..... B42C 11/02

[52] U.S. Cl. ..... 412/4; 412/5; 412/11; 412/12; 412/18; 412/19

[58] Field of Search ..... 412/4, 5, 11, 12, 18, 412/19, 9

[56] References Cited

U.S. PATENT DOCUMENTS 2,223,325 11/1940 Larney ..... 412/4
3,816,866 6/1974 Miaskoff et al. . .
5,061,138 10/1991 Allsopp et al. ..... 412/4

*Primary Examiner*—Paul A. Bell
*Attorney, Agent, or Firm*—Michael, Best & Friedrich

[57] ABSTRACT

An apparatus for applying covers to books of signatures transported along a binding line includes cover feeders for feeding at least two covers upon a conveyor line and a fastening arrangement for joining the covers in substantially superimposed registration on the signatures at a covering station on the binding line. A spacer bar is supported on the conveyor line for temporarily separating the covers before they are joined to the signatures.

22 Claims, 3 Drawing Sheets

APPARATUS AND METHOD FOR APPLYING COVERS TO SIGNATURES

TECHNICAL FIELD

The present invention relates generally to an apparatus and method for assembling signatures into booklet or magazine form and, more particularly, to an apparatus and method of providing covers or wrappers for signatures.

BACKGROUND OF THE INVENTION

Collating and binding systems are well known in the printing industry for mass producing booklets, magazines, catalogues, advertising brochures and the like. Typically, one or more sharply folded and generally pre-printed blanks or signatures are sequentially fed by a number of spaced signature feeders. The signatures are delivered such that the signatures come to rest upon a collating conveyor line which travels past the signature feeders. The conveyor gathers the signatures, one on top of the other, and moves them to a binding station. The assembled signatures then are usually diverted to a trimming station and further led to a labeling station where mailing labels are affixed.

Prior art systems of this type contemplate the computer controlled production of various demographic editions of books or catalogues of internal and external (cover) signatures containing individually tailored information or customized printing on selected signatures. This flexibility is important in satisfying the demands of a particular market or geographical destination. For instance, it may be desirable to offer certain customers or subscribers various features or selected advertising depending upon their special interest, income or occupation. Likewise, it may be relevant to customize products or services contingent upon a customer's previous buying history. As an example, a publication may issue one demographic edition for parents of newborn children who have purchased baby products, another edition for farmers interested in the latest milking machines and still another edition for fitness buffs who have ordered exercise equipment.

Included in the demographic binding station is a mechanism for applying a particular external signature or cover to the gathered signatures. One example of this type of system is disclosed in U.S. Pat. No. 3,816,866 issued Jun. 18, 1974 to Miaskoff et al. In this arrangement, a first cover feed assembly is provided to feed single covers to a cover conveyor. In the event of malfunctioning of the first cover feed assembly, a second cover feed assembly is activated to feed single covers to the cover conveyor. A detector is employed to prevent either a failure to feed a cover or a feeding of double covers. The single cover fed to the cover conveyor is provided with an adhesive and is then applied to a collection of signatures to form a bound book. The book is transported to a trimmer where the book is trimmed as desired and is finally delivered to a labeler to be addressed to a subscriber who is to receive the particular edition of the book.

The recipient of a book produced by the aforedescribed system may experience the partial obliteration of the cover information, artwork or photography caused by the size and position of the mailing label. In addition, the unprotected cover may arrive torn, watermarked, folded or otherwise violated. Some attempts have been made to alleviate these problems by variously encasing or wrapping the bound book in plastic or the like and then applying the mailing label to the wrapper off-line. However, this scheme has not only been expensive but poses an environmental problem because of the slowly degradable nature of the wrapping material.

Accordingly, it is desirable that a demographic bindery system preserve a greater degree of integrity of the finished book, provide a cost efficient design offering different types of covers, and allow for a protective, disposable wrapper which is environmentally acceptable.

SUMMARY OF THE INVENTION

The present invention advantageously provides an improved assembly and covering capability for the high speed collating and binding of customized books of signatures. The improved system is particularly versatile and is readily adaptable to existing systems with little modification.

These and other advantages are realized, in one aspect of the invention by an apparatus delivering covers to a conveyor line and applying these covers to at least one signature transported along a binding line having a covering station. The system comprises cover feeders for feeding at least a first cover and a second cover upon the conveyor line and a fastening arrangement for joining the covers together in substantially flattened, substantially superimposed registration on at least one signature at the covering station.

The present invention also relates to a method for applying covers to at least one signature transported along a binding line having a covering station. The method includes delivering at least a first cover to a conveyor line, delivering at least a second cover to the conveyor line and joining the first cover and second cover together in substantially flattened, substantially superimposed registration on the at least one signature at the covering station.

In a highly preferred embodiment, the invention contemplates that the first, or outermost, cover is comprised of a kraft paper which is readily separable from the second cover. A tabbing station is also envisioned to provide a temporary closure between the front and back portions of the outermost cover.

BRIEF DESCRIPTION OF THE DRAWINGS

The invention will become better understood by reference to the following detailed description of the preferred exemplary embodiment when read in conjunction with the appended drawings wherein like numerals denote like elements and.

DETAILED DESCRIPTION OF THE PREFERRED EMBODIMENT

Figure 1:
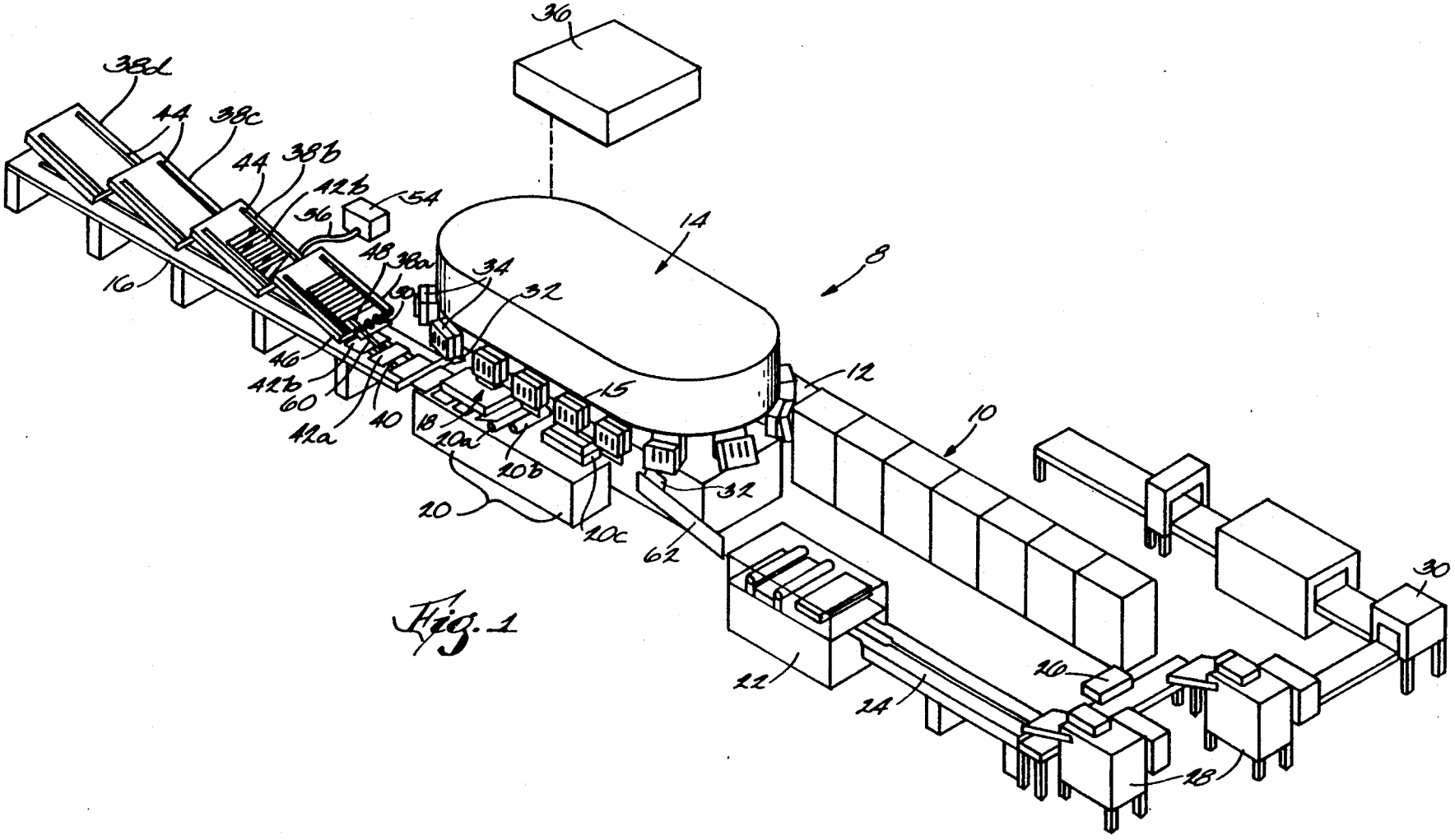
FIG. 1 is a fragmentary, perspective view of a demographic bindery system employing the present invention.

Referring to FIG. 1, a demographic binding system 8 encompassed by the present invention is employed to produce various magazines, catalogues, brochures, periodicals, or other publications containing different collections of signatures for different customers or subscribers. System 8 suitably comprises a gatherer 10, a collating conveyor 12, a perfect binder 14, a cover conveyor 16, an adhesive station 18 and a cover applicator 20. Other equipment in the system include a trimmer 22, a labeling station 24, a tabbing machine 26, strapping machines 28 and a bundle wrapping machine 30.

Collating conveyor 12 collects various folded signatures from gatherer 10 and transports them in a stack to perfect binder 14 where the signatures 32 are transferred to clamps 34 and controllably conveyed around perfect binder 14 on binding line 15. Here, signatures 32 are held along one longitudinal edge so that their respective folds, or backbones, are directed downwardly. In this orientation, each group of signatures 32 is initially trimmed along its held longitudinal edge, and is then roughened along its backbone. Following these preparations, signatures 32 are bound into assembled books, in accordance with the present invention, at adhesive station 18 and cover applicator 20 and are further conveyed to trimmer 22 where edges are further trimmed as desired. Thereafter, assembled books are transferred to labeling station 24 where a mailing label is printed or otherwise applied, and may be conveyed to tabbing machine 26 at which one or more closure tabs are applied to hold books closed during mailing. In some instances, removable inserts which are blown in or otherwise inserted between the pages of books before the books reach tabbing station 26 are also maintained in place by using the closure tabs. Strapping machines 28 may also be provided after labeling station 24 and tabbing machine 26 to place retaining straps around the books. The finished books may then be routed to wrapping machine 30 which bundles and readies them for mail or other distribution.

The demographic collating and binding system generally described above is controlled by a conventional computer or programmable controller 36, the details of which are well known in the art. Likewise, gatherer 10, perfect binder 14, trimmer 22, labeling station 24, tabbing machine 26, wrapping machine 28 and strapping machine 30 are of conventional construction and do not require a detailed discussion. Controller 36 is preferably operatively connected to all of the foregoing major components and provides controls signals thereto.

Figure 2:
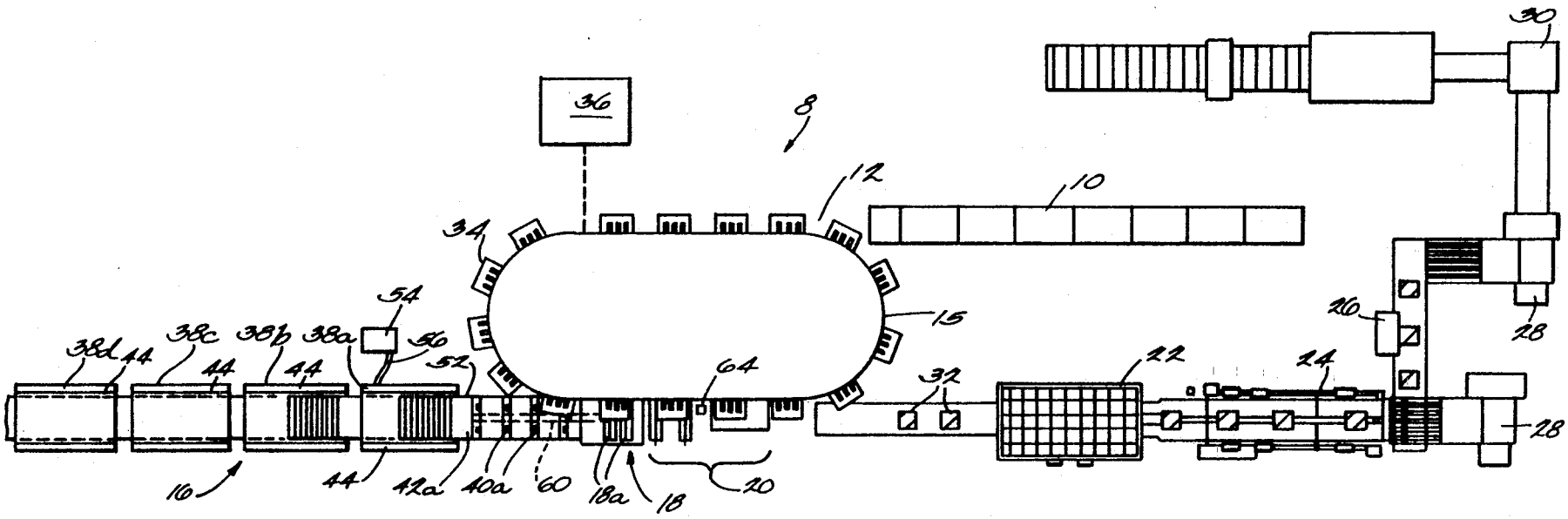
FIG. 2 is a top view of the system shown in FIG. 1.
Figure 3:
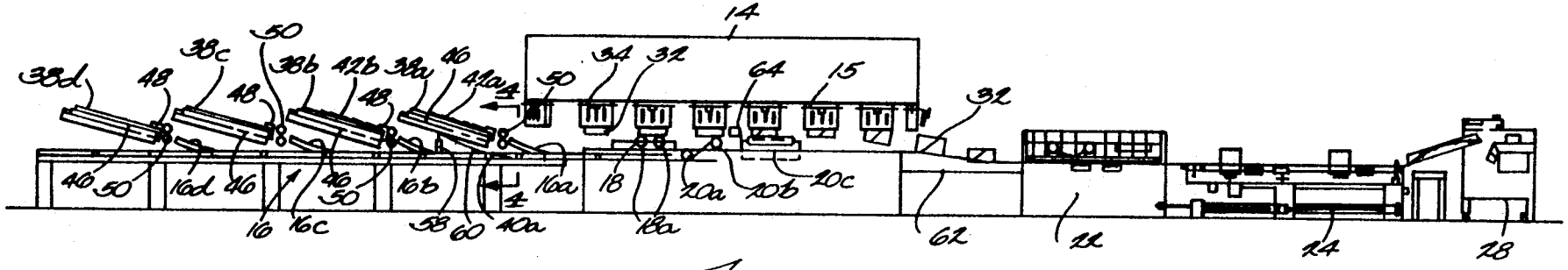
FIG. 3 is a front elevational view of the system shown in FIG. i.

A cover and wrapping arrangement embodying the present invention suitably comprises cover conveyor 16 upon which is mounted a series of cover feeders 38 each of which is disposed at an angular position by braces (not shown) with respect to the generally flat surface of conveyor 16. As illustrated in FIG. 2, a set of endless belts 40 is provided with pushing lugs 40*a* and driven in conventional manner to provide a moving surface throughout the open portion or raceway of conveyor 16. As illustrated in FIG. 3, a series of channels 16*a, b, c, d* are formed on conveyor 16 to facilitate communication between each cover feeder 38 and belts 40. In the drawings, four cover feeders 38*a, b, c, d* are shown in series to allow for as many as four different book covers to be applied but it should be understood that any number of cover feeders may be employed contingent upon the type of covers offered. In the preferred embodiment at least two covers are desired for each book so that each cover feeder 38*a, b* holds an imbricated supply of unfolded covers 42*a, b* which are aligned by registration guides 44 and controllably delivered by a feeder conveyor 46 to a suction device 48. Controller 36 actuates suction device 48 to move an open or unfolded cover 42*a*, between a pair of driven feed rollers 50 for delivery between a pair of parallel cover guides 52 on cover conveyor 16. Adjacent cover feeder 38*a* is a glue dispenser 54 which selectively meters hot glue through a delivery hose 56 to a dispensing nozzle 58 mounted beneath cover feeder 38*a* for application to cover 42*b* as will be appreciated hereafter.

Figure 4:
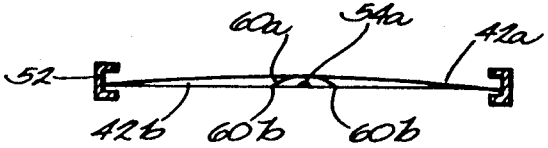
FIG. 4 is a fragmentary, cross sectional view of a spacer bar used with the present invention.

Focusing now on FIG. 3, an elongated, metallic spacer bar 60 for temporarily separating covers 42*a, b* is supported on and runs generally medially of cover conveyor 16. Spacer bar 60 extends from beneath cover feeder 38*a* and terminates downstream at adhesive station 18. As seen in FIG. 4, spacer bar 60 has a concave portion 60*a* engageable with the bottom of cover 42*b* and bottom edges 60*b* in contact with the top of cover 42*a*.

In the preferred embodiment, as gathered books are conveyed by perfect binder 14, controller 36 transmits appropriate signals to actuate cover feeders 38*a, b* to feed covers 42*a, b* to cover conveyor 16. According to the present invention, cover feeder 38*b* delivers first, or outermost, cover 42*b* to channel 16*b* during which passage a strip 54*a* (FIG. 4) of hot glue is dispensed along the midportion of cover 42*b* via nozzle 58. The glue used in step 54*a* is preferably formulated to provide high shear strength, low viscosity and low peel strength which means it is easily peelable or releasable to facilitate substantially non-destructible separation of covers 42*a, b*. Such adhesive is commercially sold as hot melt 70-3704 and 34-2602 by National Starch and Chemical Company. After glue is applied, cover 42*b* falls upon moving belts 40 and is directed beneath spacer bar 60 and along conveyor 16 by pushing lugs 40*a*. Meanwhile, cover feeder 38*a* delivers a second, or innermost, cover 42*a* to channel 16*a* and on top of spacer bar 60 so that second cover 42*a* will ride in substantially flattened, superimposed registration over and adjacent first cover 42*b*. The travelling registration of covers 42*a, b* is made possible due to the controlled feeding of the covers 42*a, b* as well as the physical guiding of covers 42*a, b* by pushing lugs 40*a* and cover guides 52. As seen best in FIG. 4, spacer bar 60 serves to temporarily separate covers 42*a, b* and shield the strip 54*a* of glue as it sets on first cover 42*b*.

Referring now to FIGS. 2 and 3, covers 42*a, b* are instantly merged together as they reach the end of spacer bar 60 at adhesive station 18 and are joined together in substantially flattened registration by means of glue strip 54*a*. Simultaneously, rollers 18*a* at adhesive station 18 apply a second strip of glue to the backbone of signatures 32 traveling in each clamp 34. The glue applied at adhesive station 18 is markedly different from the glue utilized in strip 54*a* in that it exhibits a much greater bonding strength which is intended to provide substantially permanent adhesion of cover 42*a* to the back of a book. Such adhesive is commercially sold as hot melt 34-1123 by National Starch and Chemical Company. Immediately after the second strip of glue is applied, pushing lugs 40*a* of endless belt 40 direct covers 42*a, b* past guide 20*a* to an applier drum 20*b* where the covers 42*a, b* are joined to the back of a book held in moving clamp 34 on binding line 15 by virtue of the second glue strip. Thereafter, a conventional cover breaker 20*c* is employed to fold covers 42*a, b* about the book. The finished book is then conveyed by clamp 34 and released into a chute 62 which serially feeds the book to trimmer 22, labeling station 24, and tabbing, strapping and further wrapping machines 26, 28, 30, respectively, as desired.

As a salient feature of the invention, each finished book is provided with at least two covers. In the system described above, the first, or outermost, cover 42b is preferably comprised of kraft paper and serves as a protective wrapper for second, or inside, cover 42a and the remainder of the book. Cover 42b may be blank or preprinted with customized or common information as desired on its outside and inside surfaces. Because of the peelable nature of glue in strip 54a, cover 42b is intended to be substantially separable and disposable as desired from cover 42a which is bound more strongly to the book. The kraft paper used for cover 42b is environmentally preferable to other cover materials because of its normal decomposition ability. Second or innermost cover 42a is usually the actual cover of the book and may display artwork, photography, and other information worthy of protection. Again, the outside and inside of cover 42a may carry a customized message relating to renewal of the book, special offers, and the like. To further ensure the integrity of the book, one or more severable closure tabs are preferably applied at tabbing machine 26 to adhesively engage the front and back of outermost cover 42b in order to prevent covers 42a, b from opening during the mailing or distribution process. Any removable inserts between the pages of the books are likewise maintained in position.

It should be appreciated that the present invention greatly enhances the flexibility of customizing and assembling of signatures and covers in a collating and binding system. Such flexibility is attained without significant losses in operating speeds and without creating additional problems in handling of found signatures. The preferred form of the invention is easily adaptable to existing systems and offers a versatility in handling signature and cover stocks of various weights, sizes and finishes.

Unlike prior art systems which emphasize the feeding of singular covers, the present invention contemplates the feeding and improved alignment of multiple covers for further customizing and protecting a book. With this innovative arrangement, in-line wrapping and covering operations are combined which considerably improve savings over separate in-line and off-line finishing operations.

While the invention has been described with reference to a preferred embodiment, those skilled in the art will appreciate that certain substitutions, alterations and omissions may be made without departing from the spirit thereof. For example, it should be understood that at least two covers may be provided for any book. This can be accomplished by using at least two cover feeders 38 or, in some cases, by feeding joined double or multiple covers in at least two layers from cover feeders 38 as desired. Likewise, it should be noted that the covers may be applied to as little as signature to form a book. It should also be appreciated that any combination or type of folded or unfolded covers may be employed and that these covers may be further supplemented by customization inline or offline such as with ink jet, impact and/or laster printers. Further, spacer bar 60 may be constructed in various shapes and of various materials such as plastic, and may be used in combination with other similar spacer bars between covers 42a, b. Moreover, the system may include an optical device such as a camera 64 located adjacent covering station 20 for monitoring the joining of covers 42a, b to each book. Camera 64 may be connected to other devices (not shown) for actually correcting the registration before covers 42a, b are joined to a book. Accordingly, the foregoing description is meant to be exemplary only and should not be deemed limitative on the scope of the invention set forth in the following claims.

I claim:

1. A method for applying covers to at least one signature transported along a binding line, said binding line having a covering station, the method comprising the steps of:

delivering at least a first cover to a conveyor means;

delivering at least a second cover to said conveyor means; and joining said first cover and said second cover together in substantially flattened, substantially superimposed registration on said at least one signature at said covering station.

2. A method for applying covers to at least one signature transported along a binding line, said binding line having a covering station, the method comprising the steps of:

delivering at least a first cover to a conveyor means;

delivering at least a second cover to a conveyor means in substantially flattened, substantially superimposed registration substantially adjacent said first cover;

temporarily spacing said first cover and said second cover;

joining said first cover and said second cover together in substantially flattened, substantially superimposed registration; and applying said first cover and said second cover joined together to said at least one signature at said covering station.

3. A method for applying covers to a book of signatures transported along a binding line, said binding line having a covering station, the method comprising the steps of:

delivering at least a first cover to a conveyor means;

applying at least a first adhesive to said first cover;

providing at least a second cover to said conveyor means in substantially superimposed registration substantially adjacent said first cover;

temporarily separating said first cover and said second cover from each other during said providing;

joining said first cover and said second cover in substantially superimposed registration by means of said first adhesive to form a cover assembly;

applying a second adhesive to said book; and applying said cover assembly to said book.

4. An apparatus for delivering covers to a conveyor means and applying said covers to at least one signature, said at least one signature being transported along a binding line, said binding line having a covering station, the apparatus comprising:

cover feeding means for feeding at least a first cover and a second cover upon said conveyor means; and fastening means for joining at least said first cover and said second cover in substantially superimposed registration on said at least one signature at said covering station.

5. The apparatus of claim 4, wherein the apparatus includes a spacer means for temporarily separating said first cover and said second cover on said conveyor means prior to said joining of said first cover and said second cover, said spacer means being intermediate said cover feeding means and said fastening means.

6. The apparatus of claim 4, wherein the apparatus includes an adhesive means for applying glue to at least one of said first cover and said second cover.

7. The apparatus of claim 6, wherein said adhesive means includes a first adhesive means for applying glue to said first cover before delivery of said first cover to said conveyor means.

8. The apparatus of claim 6, wherein said adhesive means includes a second adhesive means for applying glue to said at least one signature.

9. The apparatus of claim 4, where said first cover is comprised of kraft paper.

10. The apparatus of claim 4, wherein at least one of said first cover and said second cover comprises at least two layers.

11. The apparatus of claim 4, wherein the apparatus includes registration means for effecting said substantial registration of said first cover and said second cover.

12. The apparatus of claim 4, wherein the apparatus includes control means for controlling said feeding.

13. The apparatus of claim 4, wherein the apparatus includes control means for controlling operation of said fastening means.

14. The apparatus of claim 4, wherein said first cover is substantially separable from said second cover after said joining of said first cover and said second cover.

15. The apparatus of claim 4, wherein the apparatus includes a closure means for applying a closure to said first cover, said closure means being downstream of said covering station.

16. The apparatus of claim 4, wherein the apparatus includes an optical means for monitoring said joining of said first cover and said second cover to said at least one signature.

17. An apparatus for delivering covers to a conveyor means and applying said covers to books of signatures transported along a binding line, said binding line having a covering station, the apparatus comprising:

first cover feeding means for feeding at least a first cover to said conveyor means;

second cover feeding means for feeding at least a second cover in substantially flattened, substantially superimposed registration substantially adjacent said first cover on said conveyor means, said second cover feeding means being downstream of said first cover feeding means;

spacer means for temporarily separating said first cover and said second cover, said spacer means being located along said binding line intermediate said second cover feeding means and said covering station;

fastening means for joining said first cover and said second cover in substantially superimposed registration, said fastening means being located downstream of said spacer means intermediate said second cover feeding means and said covering station; and application means for applying said first cover and said second cover to said books at said covering station.

18. The apparatus of claim 17, wherein said spacer means is an elongated bar.

19. The apparatus of claim 18, wherein said elongated bar has a concave portion engageable with said second cover.

20. The apparatus of claim 17, wherein said spacer means generally extends from substantially said second cover feeding means to substantially adjacent said fastening means.

21. The apparatus of claim 17, wherein said first cover comprises a protective, disposable wrapper, said protective disposable wrapper being removable from said second cover after said joining of said first cover and said second cover to said books.

22. The apparatus of claim 17, wherein said second cover feeding means includes an adhesive delivery means for applying a peelable glue to said first cover, said peelable glue having a peel strength appropriate to facilitate substantially non-destructible separation of said first cover from said second cover.

* * * * *